US008104095B2

(12) United States Patent
Cyr et al.

(10) Patent No.: US 8,104,095 B2
(45) Date of Patent: Jan. 31, 2012

(54) PROTECTIVE FACE MASK

(75) Inventors: Raymond Cyr, Laval (CA); Richmond Italia, Ile Bizard (CA); Zbigniow Migos, St-Lambert (CA); Marie-Pierre Gendron, Chateauguay (CA)

(73) Assignee: GI Sportz Inc., Quebec (CA)

( * ) Notice: Subject to any disclaimer, the term of this patent is extended or adjusted under 35 U.S.C. 154(b) by 1146 days.

(21) Appl. No.: 11/907,307

(22) Filed: Oct. 11, 2007

(65) Prior Publication Data

US 2008/0086795 A1 Apr. 17, 2008

Related U.S. Application Data

(60) Provisional application No. 60/851,054, filed on Oct. 12, 2006.

(51) Int. Cl.
*A41D 13/11* (2006.01)

(52) U.S. Cl. ..... 2/9; 2/15; 2/424; 2/425; 2/455; 2/6.7

(58) Field of Classification Search ..... 2/455, 9, 2/424, 422, 6.67, 6.7, 15, 425, 426
See application file for complete search history.

(56) References Cited

U.S. PATENT DOCUMENTS 4,446,576 A * 5/1984 Hisataka ..... 2/425
6,363,528 B1 * 4/2002 Cyr ..... 2/9
6,381,749 B1 * 5/2002 Cyr ..... 2/9
6,804,829 B2 10/2004 Crye et al.
6,886,183 B2 5/2005 DeHaan et al.
6,957,447 B1 10/2005 Broersma
7,168,095 B2 * 1/2007 Wright ..... 2/9
2004/0111779 A1 * 6/2004 Gagnon et al. ..... 2/9
2005/0204446 A1 * 9/2005 Wright ..... 2/9
2006/0085882 A1 * 4/2006 Broersma ..... 2/9
2006/0085883 A1 * 4/2006 Tan et al. ..... 2/9
2006/0090234 A1 * 5/2006 Cyr ..... 2/9
2006/0272067 A1 * 12/2006 Gagnon et al. ..... 2/9
2007/0186324 A1 * 8/2007 Sheldon et al. ..... 2/9
2008/0189821 A1 * 8/2008 Anderson ..... 2/9

* cited by examiner

*Primary Examiner* — Christopher Harmon
(74) *Attorney, Agent, or Firm* — Simple IP Law, P.C.

(57) ABSTRACT

The present invention relates to a protective mask adapted to be worn by a person engaging in the game of paintball. The mask has a main body to cover the front, sides, mouth and ears of a user's face. It also has a removable flexible transparent lens that locks into a rigid support frame formed in the mask. The mask also has a strap to securely support the mask on a wearer's head, and a removable face engaging element provided to accommodate a face of the wearer. This face engagement element evenly engages around the wearer's face in a cushioned manner because its face engagement portion is made of foam that engages the user's face along the entire perimeter of the face engagement element. The face engagement element is securely locked onto the mask by locking clips that fit into openings on both sides of the face engagement element.

3 Claims, 26 Drawing Sheets

PROTECTIVE FACE MASK

FIELD OF THE INVENTION

This application is based on U.S. 60/851,054 filed Oct. 12, 2006. The present invention relates to a protective face mask. More particularly, the preferred embodiment of the present invention relates to a protective face mask for activities such as paintball and the like. The present invention also relates to a kit for assembling a protective face mask, and to a method of use.

BACKGROUND OF THE INVENTION

It is well known in the art that sports such as paintball and the like are activities where the participants use a gun or a marker in the form of a firearm that shoots paintball capsules, generally spherical in shape, at very high velocity such as 250 to 300 feet per second. Thus, the players of such sports require appropriate protective gear to protect their eyes and faces for safety and to minimize injuries.

Protective face masks used for applications such as paintball and the like are known in the art. Most face masks on the market comprise an inner face open-cell foam portion mounted onto the frame of the mask by means of an adhesive. Considering that the foam is glued into the frame itself, it is impossible to easily replace it. The reason one would desire to replace said foam is because during game play, a player will sweat profusely thus causing the foam to become soiled, moist, and unpleasant to the wearer.

Another substantial drawback associated with conventional face masks is the fact that since the foam cannot be easily interchanged, masks rented on paintball fields pose sanitary and hygienic concerns for subsequent players.

Yet another drawback of conventional masks is the fact that glued foam portions cannot be adapted to various physical traits of a player's face. It is known in the art that maximum safety and enjoyment can only be attained if the mask fits the player snugly and securely.

There are also known in the art protective paintball face masks that comprise interchangeable face foams. For example, some face masks commercialized by the company JT™ (see www.jtusa.com) comprise a paintball mask with the option of an interchangeable foam, but this foam is generally retained in place by a hook and loop assembly (i.e. Velcro™) on the frame of the mask rather than being glued. However, there are substantial drawbacks associated with this manner of mounting the face foam onto the given mask: the Velcro™ bands will eventually cause noticeable ridges along their contours through the foam that can be felt by the user thus causing discomfort. Furthermore, the Velcro™ bands are not provided along the entire surface of the face foam; during game play, the foam can easily dislodge or slip off the intermittent Velcro™ bands thus necessitating the user to stop game play, remove the mask and properly reposition the foam. Finally, even when the foam is properly adhered using the hooks and loops, the fact that the bands are intermittent will never translate into an optimal fit to the user's face.

Hence, in light of all the aforementioned, there is a need for a mask, which by virtue of its design and components, would be able to overcome some of the above-discussed prior art problems.

SUMMARY OF THE INVENTION

The object of the present invention is to provide a mask that provides an improvement over the prior art. The preferred embodiment of the present invention is a protective face mask for sports such as paintball and the like as well as military uses. This mask is adapted to be worn by a person, and comprises a main body adapted to cover a front, sides, a mouth and ear portions, a removable flexible transparent lens adapted to be locked into a support frame formed in the mask, the support frame being made of rigid material. The mask also comprises a strap adapted to securely support the mask on a wearer's head, a face engaging element having a configuration provided to accommodate a face of the wearer, the face engaging element adapted to be removably mounted within the mask and wherein the element has a face engaging portion adapted to be evenly engaged around the face of the wearer in a cushioned manner.

The face engaging element is made of rigid material and provided with an engagement means adapted to cooperate with corresponding engagement means formed within the support frame of the mask. The face engagement portion is made of foam, adapted to engage the face along the entire perimeter of the face engagement element. The face engagement element is securely locked on the mask by means of a face engagement locking means adapted to fit into openings formed on both sides of the face engagement element. The locking means are further adapted to fit into corresponding openings formed on both sides of the support frame.

The lens is securely locked on the support frame of the mask by lens locking clips that are adapted to cooperate with lens extremities formed on both sides of the lens. These clips are provided with protrusions adapted to fit into corresponding orifices formed in the support frame, and the strap is provided with strap clips located on both sides of the strap, these clips adapted to be securely locked within corresponding openings formed within the protrusions of the lens locking clips in a male-female manner.

The mask is further provided with removable temple support elements mounted on both sides of the support frame that are adapted to provide an additional cushioning comfort to the wearer of this mask. The mask further comprises a removably-mounted visor portion.

The objects, advantages and other features of the present invention will become more apparent upon reading of the following non-restrictive description of preferred embodiments, given for the purpose of exemplification only with reference to the accompanying drawings.

DETAILED DESCRIPTION OF PREFERRED EMBODIMENTS OF THE INVENTION

In the following description, the same numerical references refer to similar elements. The embodiments shown in the figures are preferred, and are namely used for exemplification purposes only.

The present invention was primarily designed as a protective face mask 1 for sports such as paintball; it also has other applications such as military and the like. Thus, the following description should not be construed as limiting only to the enumerated applications, and should be considered on a broader spectrum.

Figure 1:
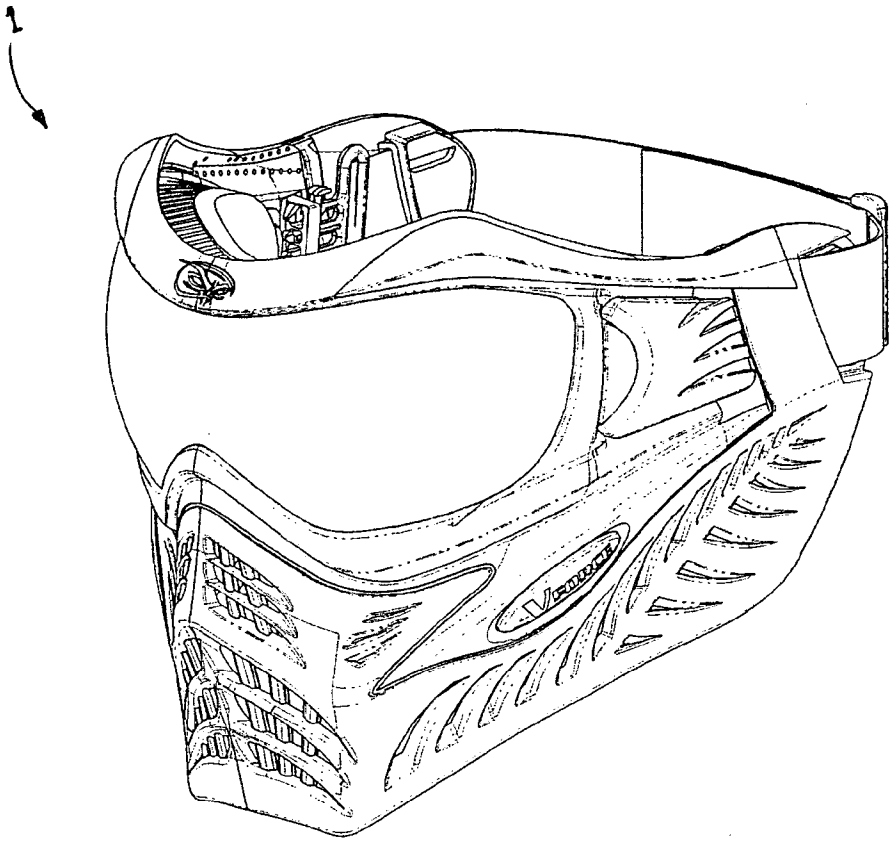
FIG. 1 is a front perspective view of a protective face mask according to a preferred embodiment of the present invention.

Referring now to drawings, FIG. 1 illustrates mask 1 according to a preferred embodiment of the present invention. As seen on FIG. 2, mask 1 comprises a substantially rigid support frame 7 and a complementary mouth and ear portion 9 that is substantially flexible, and which is either glued on or overmolded onto the substantially rigid support frame 7 via a suitable manufacturing process. The substantially rigid support frame 7 is generally provided for protecting the user and for mounting different components of the face mask, while the more substantially flexible mouth and ear complementary portion 9 protects the mouth and the ear regions of the user.

Figure 2:
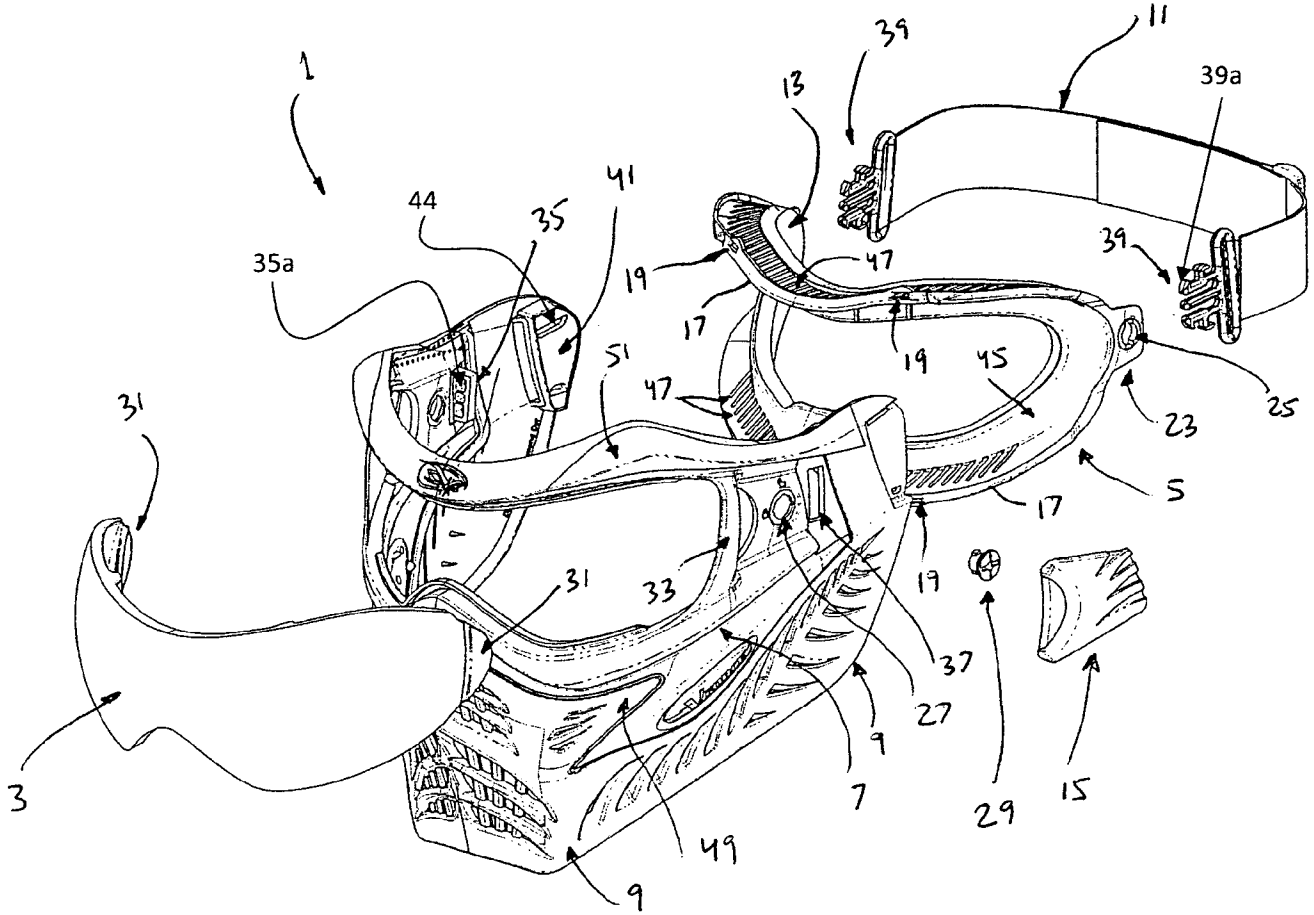
FIG. 2 is an exploded view of FIG. 1.
Figure 2B:
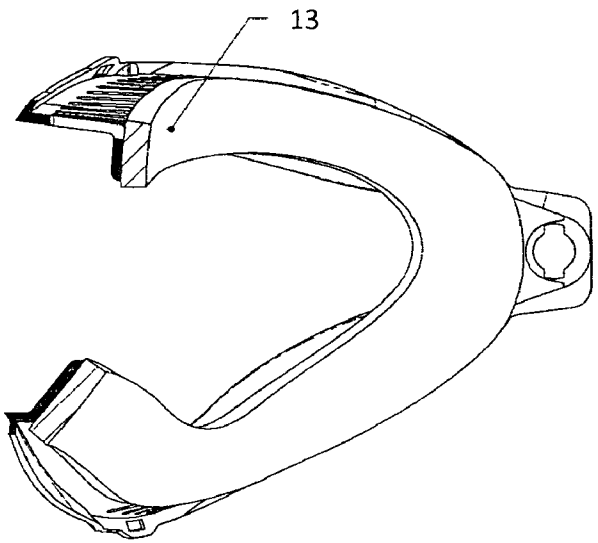
FIG. 2*b* is a cross-section of FIG. 2*a* along line A-A.
Figure 2A:
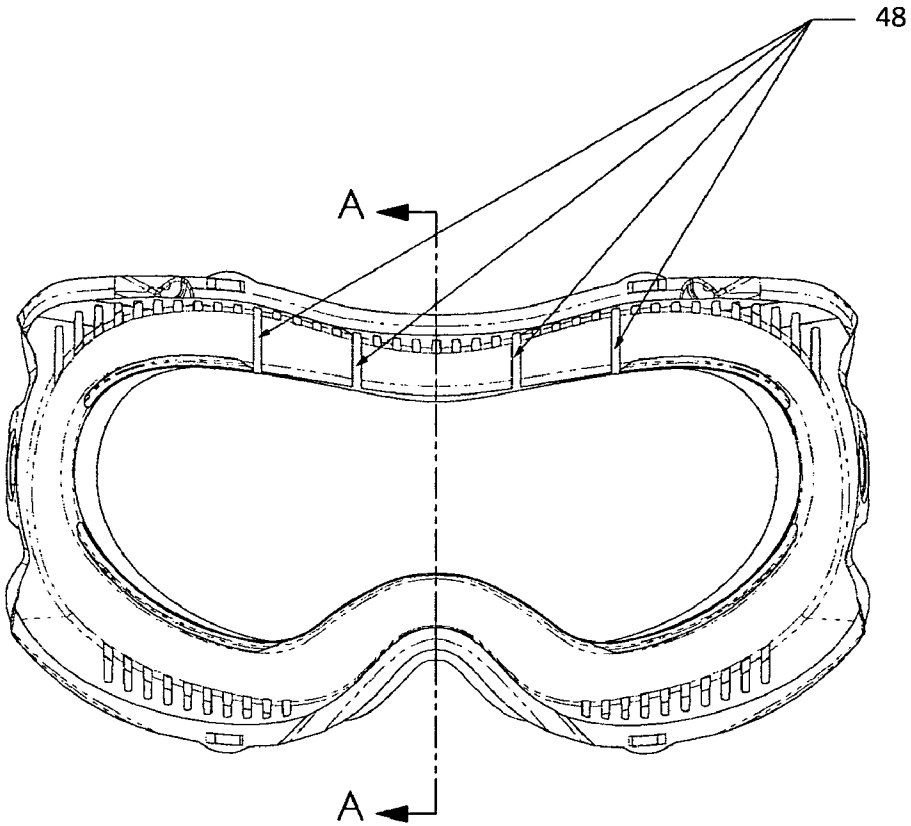
FIG. 2*a* is a front view of replaceable foam portion.
Figure 2D:
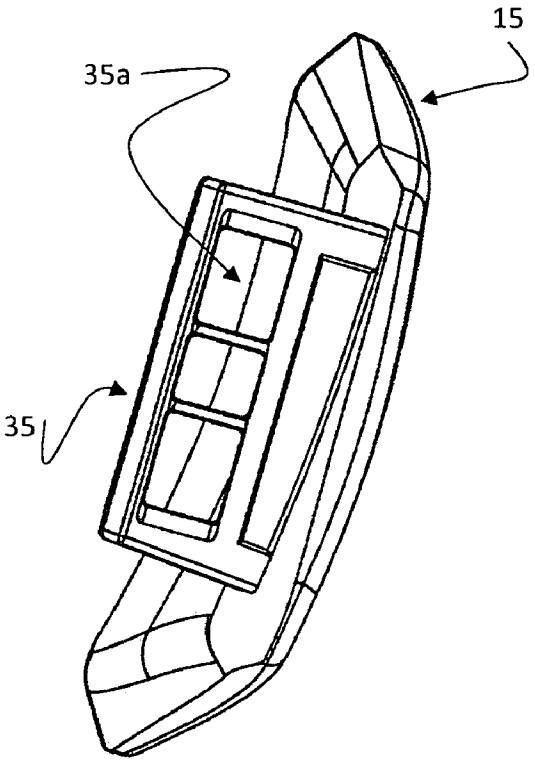
FIG. 2*d* is a front view of FIG. 2*c*.
Figure 9:
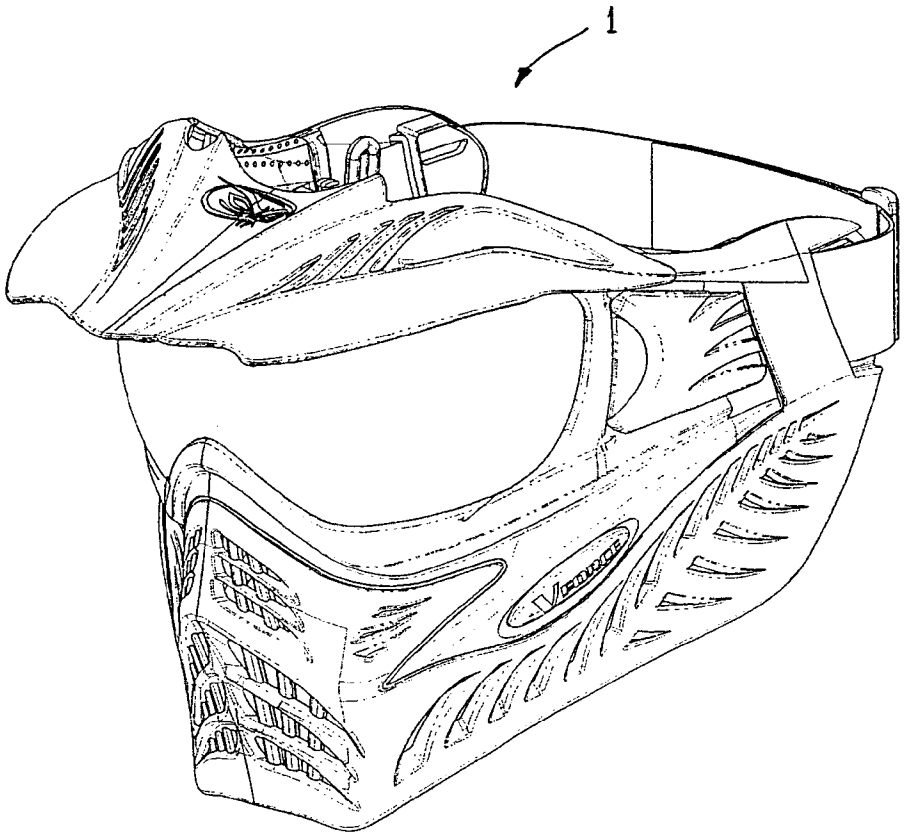
FIG. 9 is a front perspective view of a protective face mask according to another preferred embodiment of the present mask with a visor.

The substantially rigid support frame 7 is operatively rested against the face of a user, and is appropriately fastened on user's face via a corresponding fastening strap 11, as seen on FIGS. 2 and 9. Moreover, as can be easily understood when referring to FIGS. 2, 9 and FIGS. 17-23, a lens 3 is preferably provided, and is preferably removably mountable onto the substantially rigid frame 7. According to the preferred embodiment of the present invention, lens 3 is transparent to enable a user to properly see through it, and is made of a suitable material such as polycarbonate or other strong materials known in the art.

Lens 3 and frame 7 should be preferably designed so as to comply with ASTM and other norms required in the industry in terms of impact and the like, as required by the given sport for which the protective face mask is intended for. Indeed, generally, a series of tests are carried out on the protective face mask, and the latter is preferably designed so as to ensure a proper retention of the lens, without the penetration of paint from the paintballs, or any other projectile in other applications such as military applications, in the region of the eyes of the wearer as well as other sensitive regions of the wearer's head. The protective face mask according to the present invention should also be designed so as to properly withstand different ranges of temperatures.

As can be also easily understood when referring to FIGS. 2 and 9, the protective face mask according to the present invention is preferably shaped and sized so as to properly cover and shield the face of a given user, namely in the region of the eyes, such as the eyes, the eyebrows, the cheekbones, and other adjacent regions, such as the ears, the temples, and other regions of the face or of the head of the user which may be subject to the impact of paintballs and the like or the penetration of other projectiles in other applications.

As better shown in FIGS. 2 and 9, as well as in FIGS. 26-35, the protective face mask preferably comprises a face engaging element or foam support 5, provided with a corresponding face engaging portion or foam 13, which preferably acts as a cushion between the face of the given user and the substantially rigid support frame 7 of the face mask, and also preferably comprises, as aforementioned, a substantially elastic fastening strap 11 so as to properly and adequately retain the protective face mask in place about the face and/or head of the corresponding user.

Lens 3 is preferably locked into place with a pair of lens lock clips 15. These lens lock clips 15, provided on preferably the left and right sides of the protective face mask 1, respectively lock the lens 3 into place onto the substantially rigid support frame 7. Substantially rigid support frame 7 of the mask is preferably made of nylon or any other suitable material known in the art for its characteristics, and mouth and ear portion 9 is preferably made of Santoprene™ and other material known in the art for elastic characteristics.

An important aspect of the present invention is that the protective face mask also comprises a face engaging element or foam support 5 which is removably mountable onto the protective face mask, preferably onto the substantially rigid support frame 7. Foam support 5 is removably connectable and kept in place on the frame 7 to act as an interface between the mask (and more particularly, the frame thereof) and the face of a user.

Figure 5:
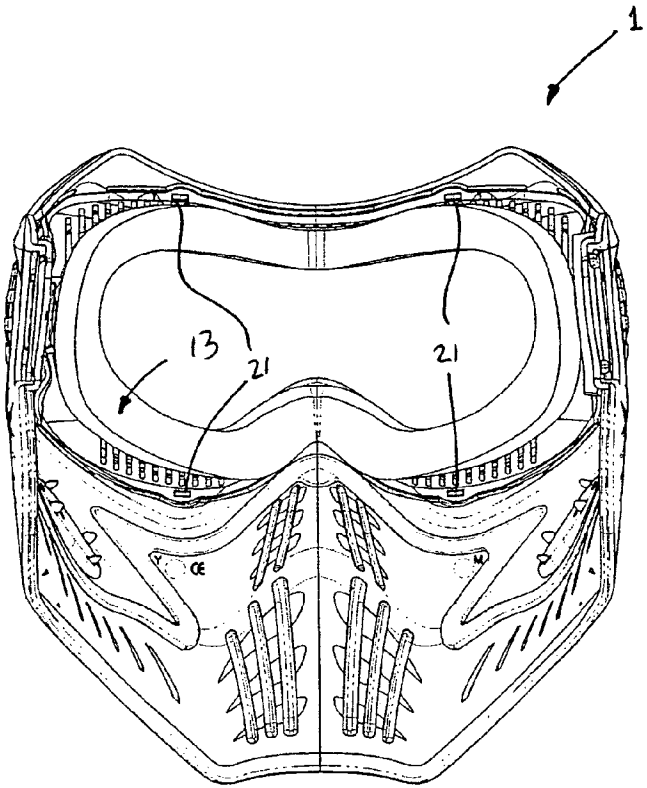
FIG. 5 is a back view of FIG. 1 without the fastening strap.
Figure 5A:
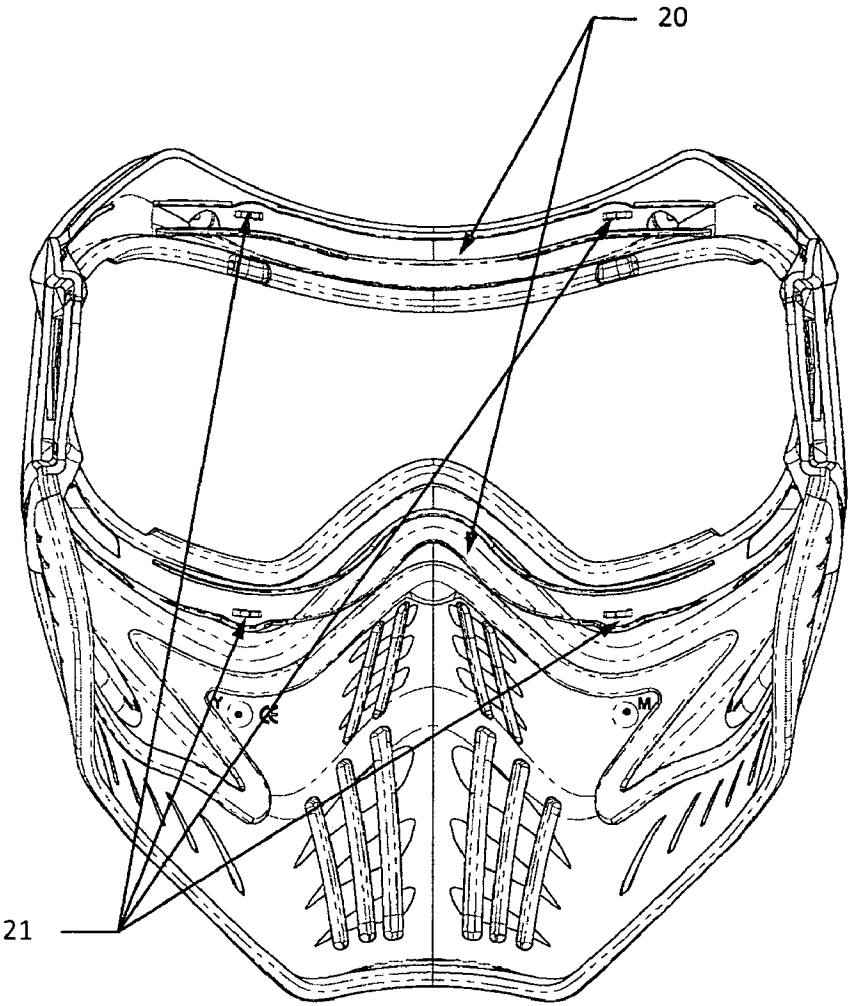
FIG. 5*a* is rear view of FIG. 1 without replaceable foam portion.
Figure 8:
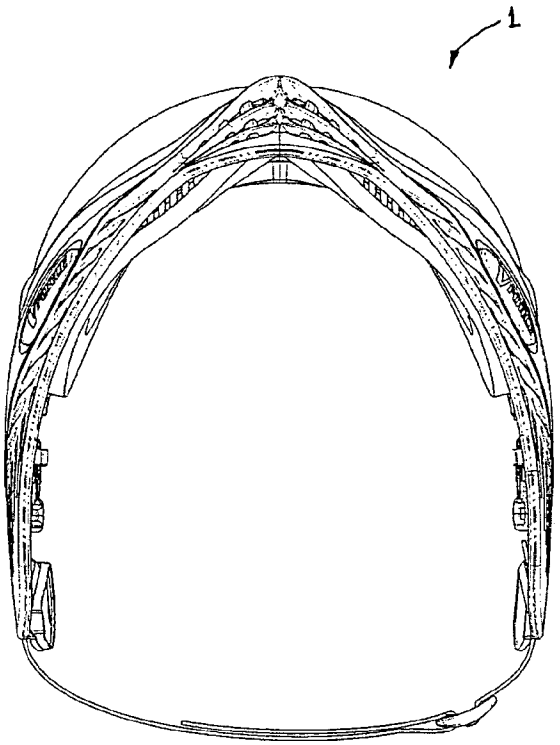
FIG. 8 is a bottom view of FIG. 1.
Figure 7:
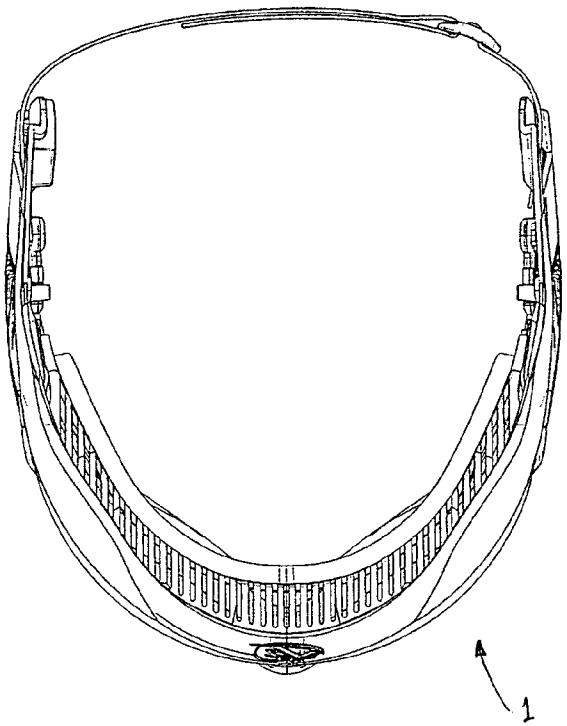
FIG. 7 is a top view of FIG. 1.

Removable and detachable foam support 5 preferably comprises rims 17 shaped and sized so as to be received into corresponding complementary recesses 20 provided along an inner portion of the substantially rigid support frame 7 (FIG. 5). Face engaging element 5 is provided with an engagement means such as orifices 19 to be introduced into corresponding engagement means formed in the support frame 7, such as alignment pins 21 (FIG. 5) projecting from said inner portion of said support frame 7. Face engagement element 5 is provided with face engagement locking means comprising side tabs 23 provided with corresponding holes 25 intended to cooperate with corresponding side holes 27 of the support frame 7 and intended to be securely affixed thereto via corresponding lock buttons 29, so as to securely maintain the foam support 5 in place when it has been properly positioned about the protective face mask, and more particularly the substantially rigid support frame 7. As can be easily understood by a person skilled in the art when referring to the accompanying drawings, and more particularly FIGS. 2 and 9, as well as FIGS. 26-35, once the lock buttons 29 have been used to properly secure the foam support 5 about the mask frame, a pair of lens lock clips 15 are clipped onto the mask, one on each side of said mask 1, so as to properly cover access to said lock buttons 29, and securely maintain the lens 3 in place, as a result of the lens lock clips 15 being shaped and sized so as to cover not only the lock buttons 29, but also cooperate with a corresponding extremity 31 of the lens 3 projecting from a side bar 33 of the mask when appropriately mounted onto the substantially rigid support frame 7, as better shown in FIGS. 2 and 9, as well as in FIGS. 17-23.

Figure 2C:
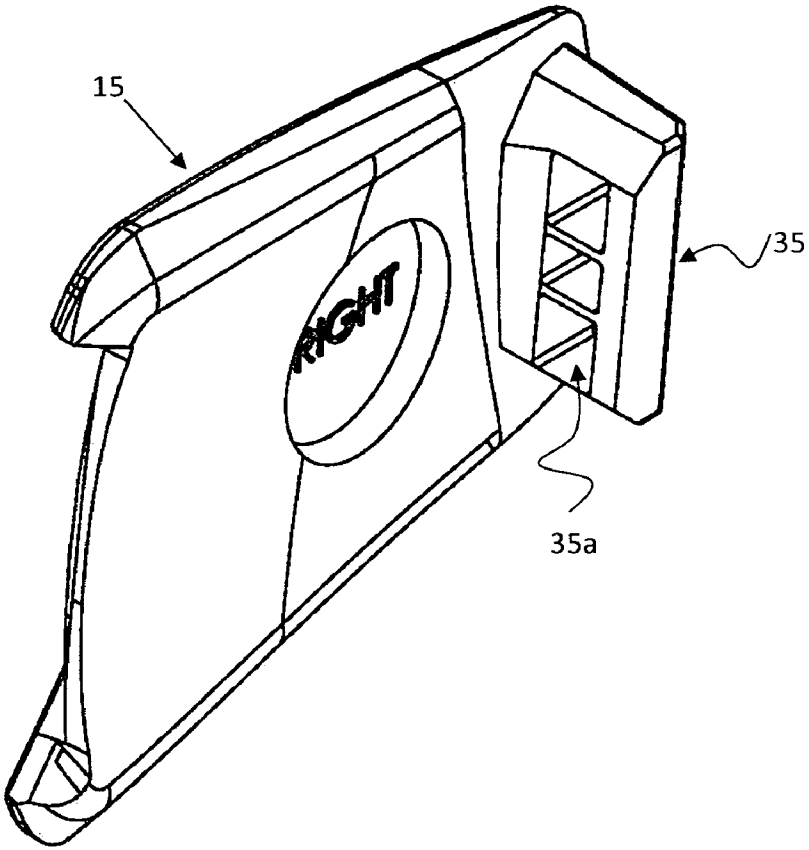
FIG. 2*c* is a perspective view of lens lock clip.
Figure 4:
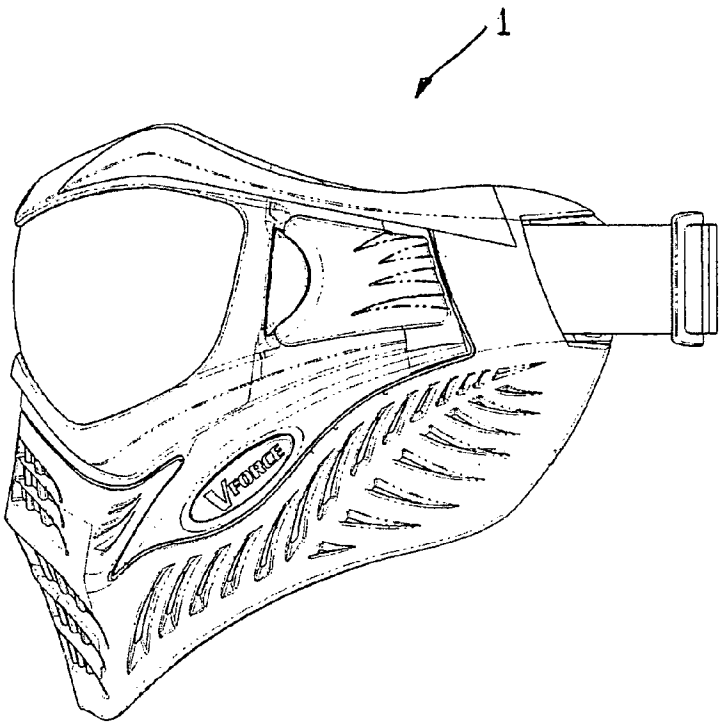
FIG. 4 is a left view of FIG. 1.
Figure 3:
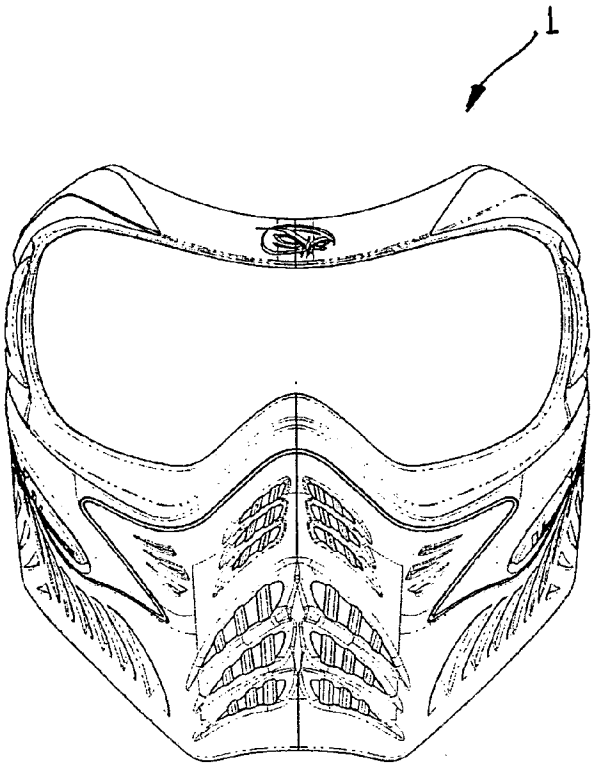
FIG. 3 is a front view of FIG. 1.
Figure 3E:
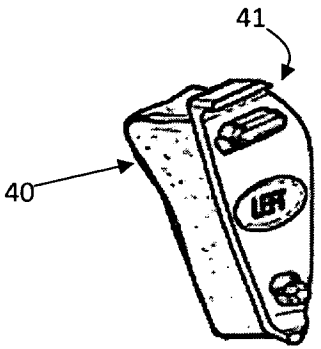
FIG. 3*e* is a perspective view of FIG. 3*a*.
Figure 3D:
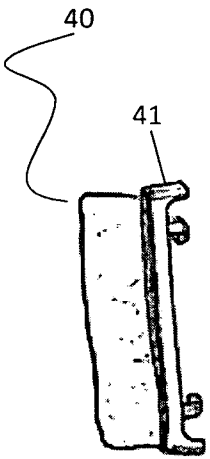
FIG. 3*d* is a left side view of FIG. 3*a*.
Figure 3C:
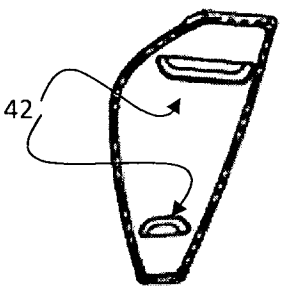
FIG. 3*c* is a back view of FIG. 3*a*
Figure 3B:
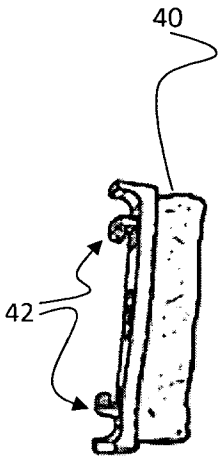
FIG. 3*b* is a right view of FIG. 3*a*.
Figure 3A:
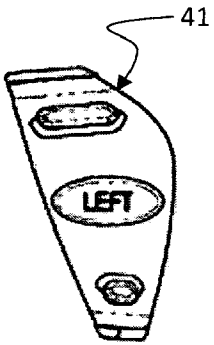
FIG. 3*a* is a back view of temple support.
Figure 6:
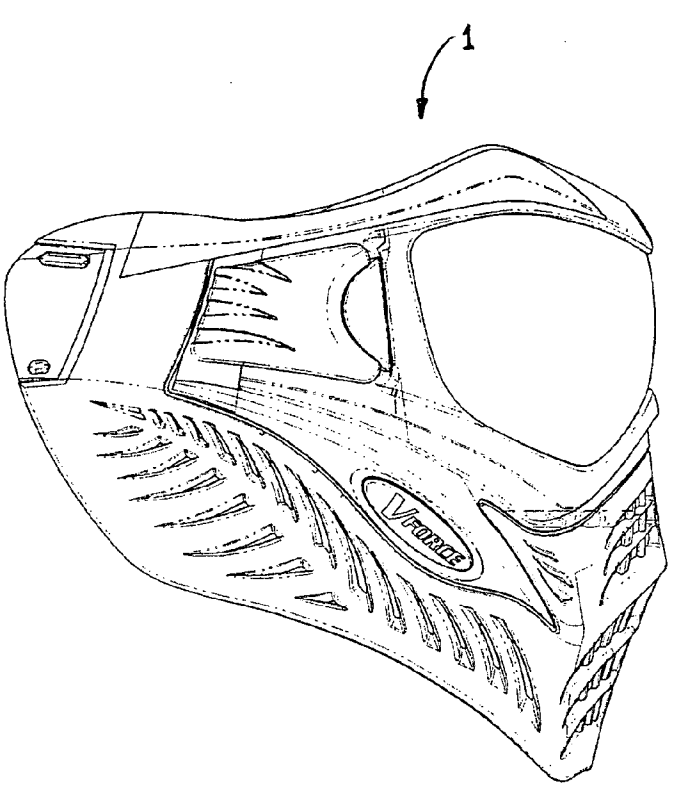
FIG. 6 is a right view of FIG. 5.

According to the preferred embodiment of the present invention, the lens lock clips 15 (FIGS. 2*c,d*) are provided with corresponding protrusions 35 intended to be inserted through corresponding side slits 37 of the protective face mask, so as to protrude from an inner portion of said mask, and so as to receive corresponding strap clips 39 located on both ends of the fastening strap 11. Protrusions 35 of the lens lock clips 15 comprise female recesses 35*a* intended to receive corresponding male protrusions 39*a* extending from the strap clips 39. As can be easily understood by a person skilled in the art when referring to the accompanying drawings and the present description, the design of such lens lock clips 15 and their interaction with the other components of the protective face mask are intended so that a user first requires to properly install and secure the foam support 5 and/or lens 3 onto the support frame 7 before being able to properly connect the strap 11 onto the mask and mounting said mask 1 onto the corresponding user, which is particularly advantageous, in that the mask is intended to ensure that the proper safety features are in place before enabling the user to use said mask. Indeed, for example, if the lock clips 15 are not properly mounted onto the protective face mask, then a user would not be able to clip the corresponding fastening straps clips 39 into said lock clips 15, and to be able to use the protective face mask with corresponding fastening strap.

Furthermore, the provision of such lens lock clips 15 is also particularly advantageous in that they are preferably intended so as to prevent the lens from being dislodged during impact of paintballs and the like.

As previously mentioned, a main function of the lens lock clips 15 is to retain the lens 3 onto the protective face mask, in the preferred manner described above, but also to retain and ensure that the lens 3 remains in place during the impact, or the repeated impacts of paintballs and the like. Without the lens lock clips 15 mounted onto the protective face mask (as seen on FIGS. 17-35), the fastening strap 11 cannot be removably connected onto the protective face mask, and the user would not be able to use the protective face mask. This procedure ensures that the user has undertaken certain preliminary safety measures regarding the mask before using it.

In addition to the above-mentioned foam support 5, the protective face mask according to the present invention comprises temple foam supports 41, as better shown in FIGS. 2, 2*a*-2*e*, which are preferably intended so as to ensure also a greater comfort and stability of the mask. More particularly, the protective face mask preferably comprises a pair of temple foam supports 41 (FIGS. 3*a*-3*e*), one on each side of mask 1. Temple foam supports 41 are preferably removably mounted onto the mask 1, and more particularly onto a rear extremity of the mouth and ear complementary assembly 9. Each temple foam support 41 comprises a pair of pins 42 projecting from a rear portion thereof, said pair of pins 42 as seen on FIGS. 3*a* to 3*e* being removably insertable and clipped into corresponding holes 44 provided along a rear portion of the mouth and ear protective overmolded assembly 9, as can be easily understood when referring to FIGS. 2 and 9. Foam 40 is glued to the face-engaging surface of temple foam supports 41. Other attachment methods of temple foam supports 41 are available to the skilled in the art.

Different suitable materials or foams known in the art can be used for the foam 13 of the foam support 5, and/or on the temple foam supports 41. Preferably, foam 13 and foam of temple support 41 is attached by gluing.

Figure 10:
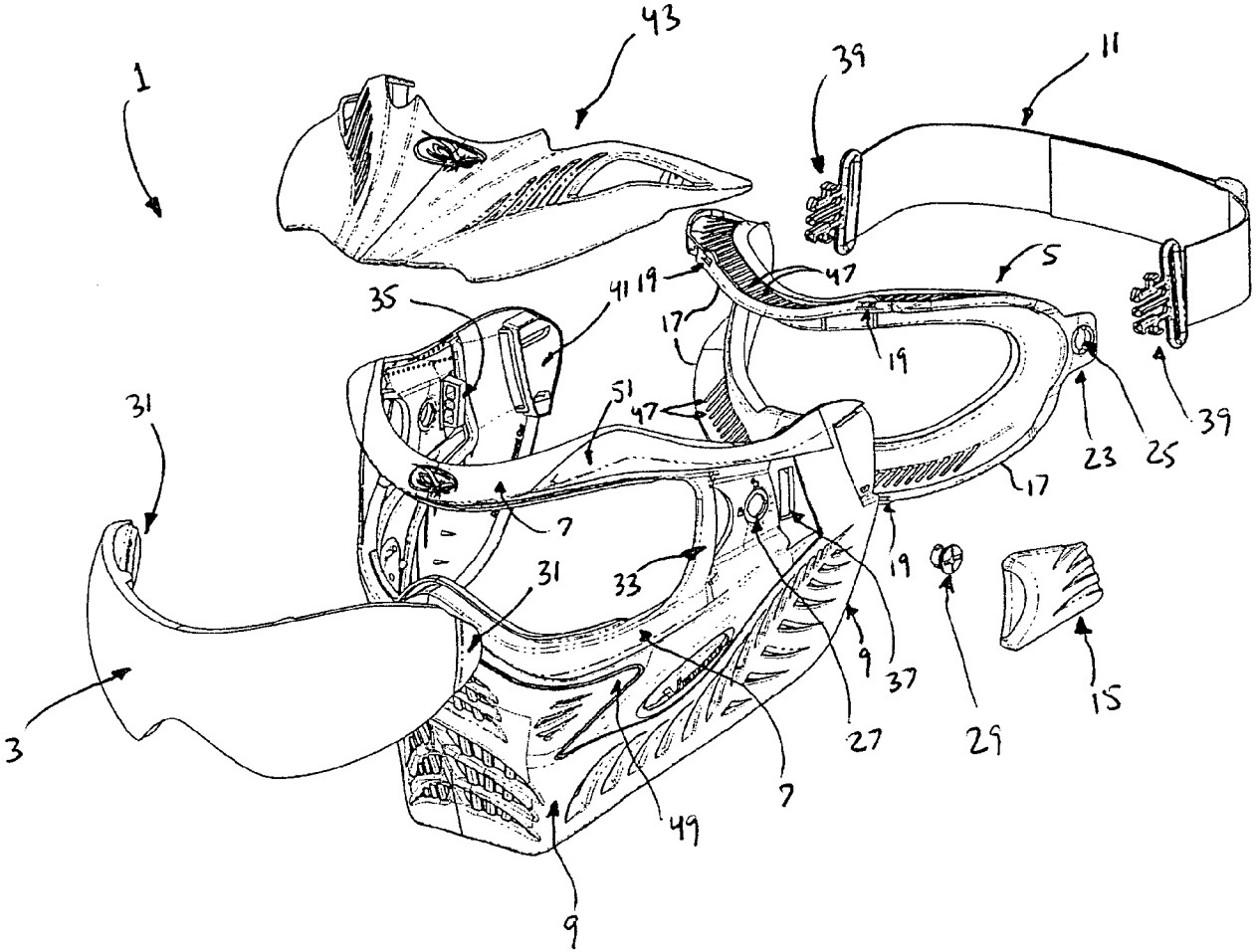
FIG. 10 is an exploded view of what is shown in FIG. 9.
Figure 10A:
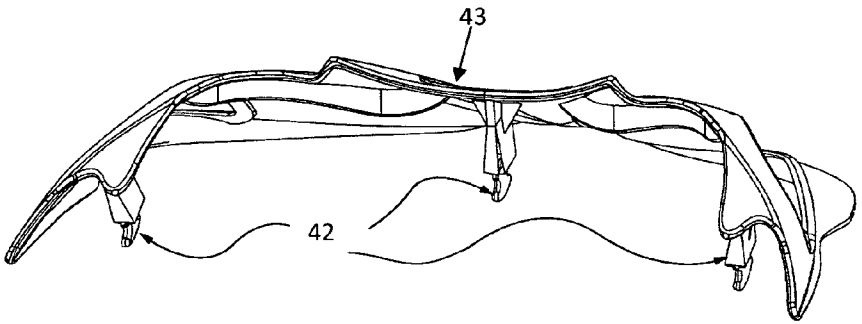
FIG. 10*a* is a top view of the visor.
Figure 10B:
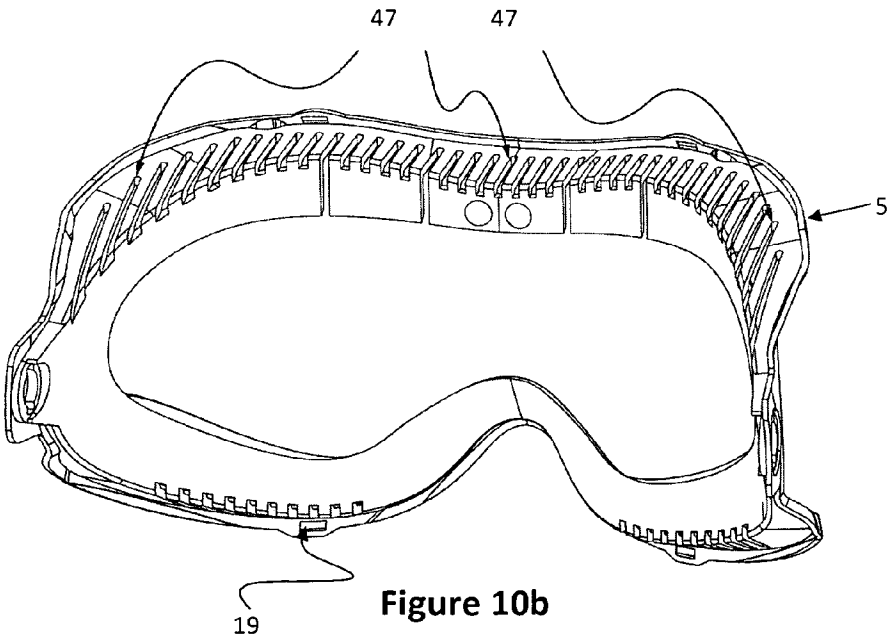
FIG. 10*b* is a rear perspective view of a face engagement element.
Figure 12:
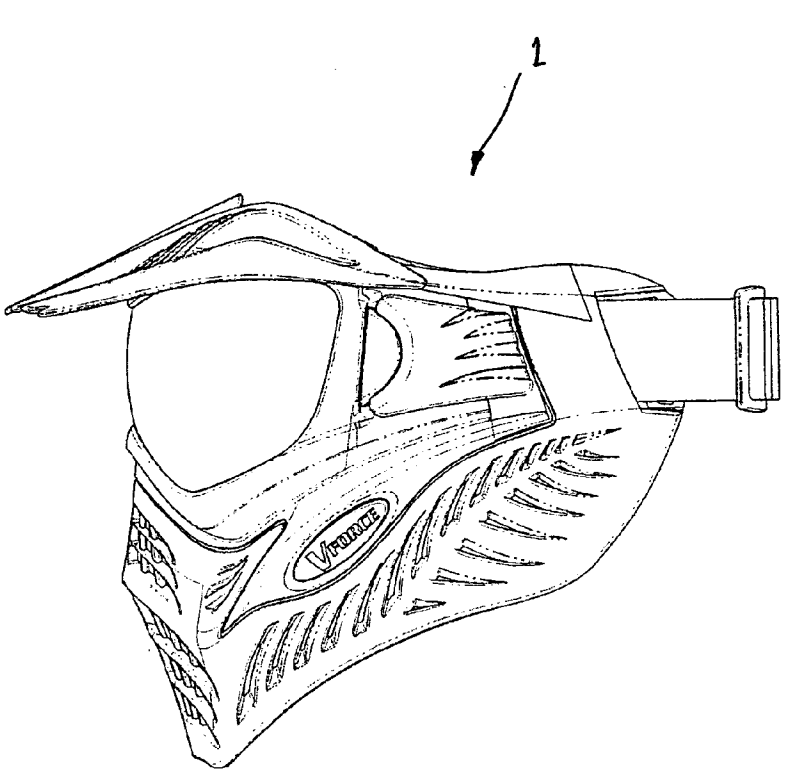
FIG. 12 is a left view of FIG. 9.
Figure 11:
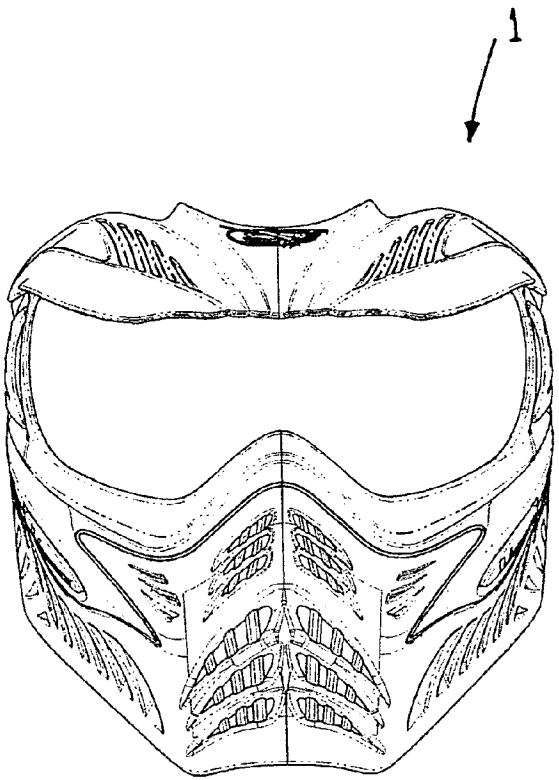
FIG. 11 is a front view of FIG. 9.
Figure 11D:
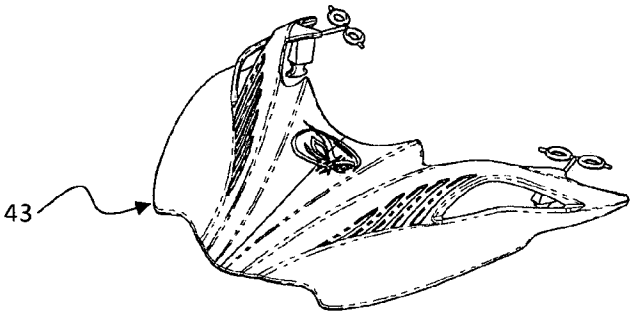
FIG. 11*d* is a perspective view of FIG. 11*a*.
Figure 11E:
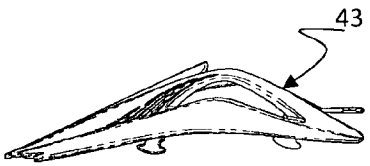
FIG. 11*e* is a left view of FIG. 11*a*.
Figure 11F:
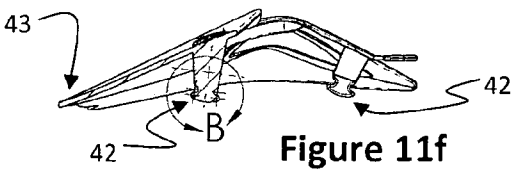
FIG. 11*f* is a cross-section view of FIG. 11*b* along line A-A.
Figure 11G:
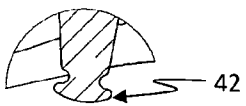
FIG. 11*g* is a view of a fragment cross-section of a visor protrusion.
Figure 11A:
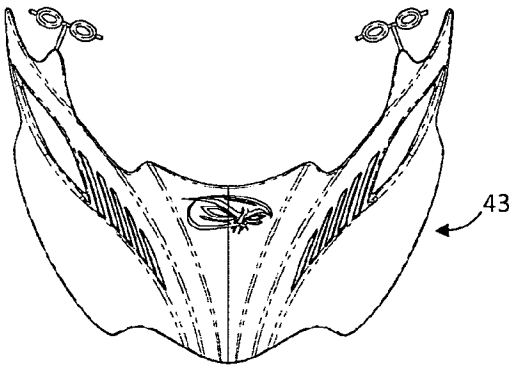
FIG. 11*a* is a top view of the visor.
Figure 11B:
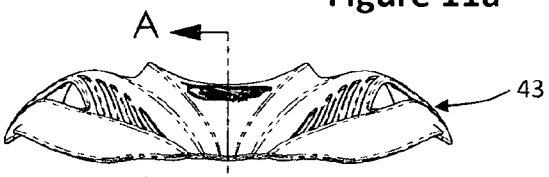
FIG. 11*b* is a front view of FIG. 11*a*.
Figure 11C:
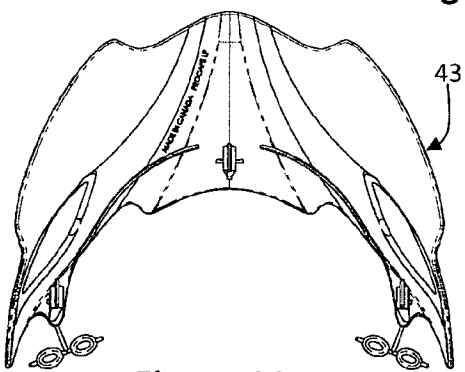
FIG. 11*c* is a bottom view of FIG. 11*a*.
Figure 14:
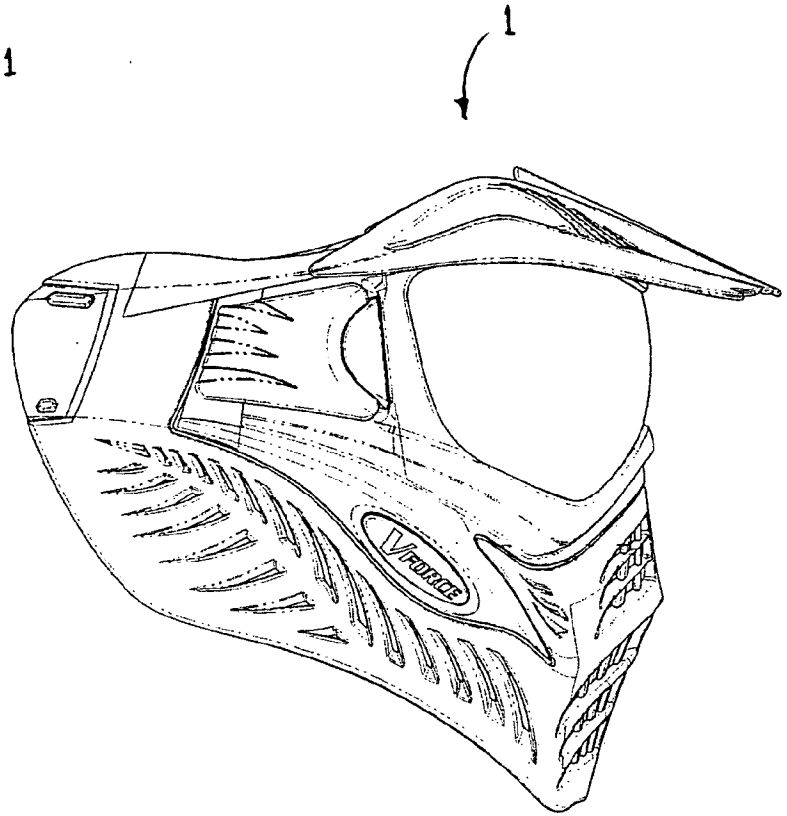
FIG. 14 is a right view of FIG. 13.
Figure 13:
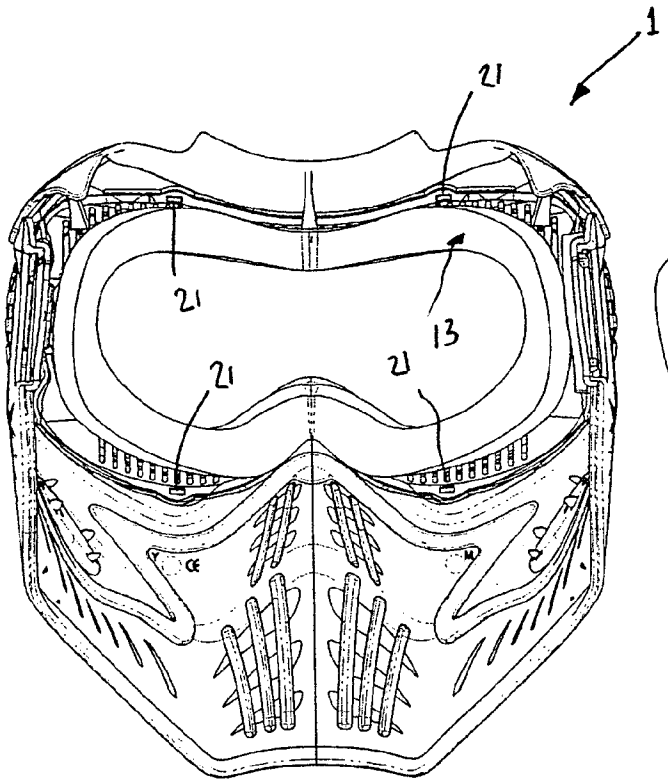
FIG. 13 is a rear view of FIG. 9 without the fastening strap.
Figure 16:
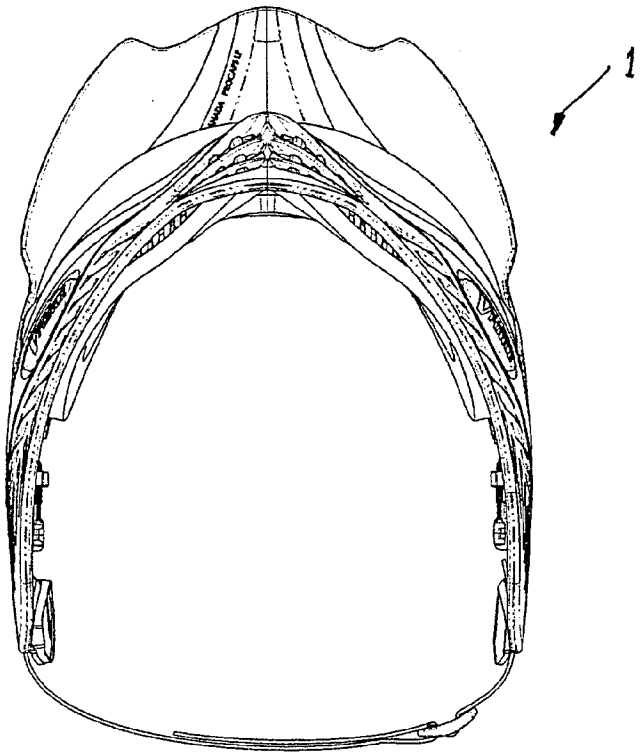
FIG. 16 is a bottom view of FIG. 9.
Figure 15:
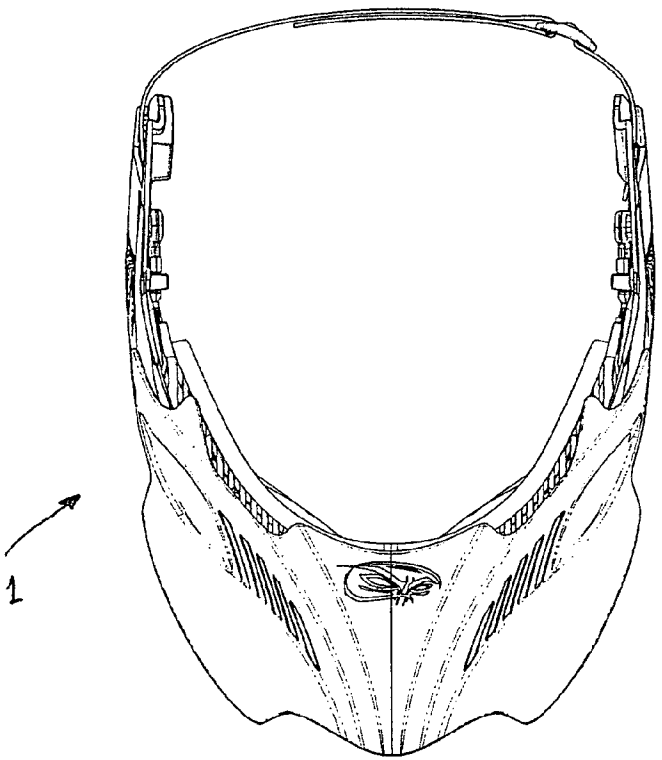
FIG. 15 is a top view of FIG. 9.

According to another preferred embodiment of the present invention, and as better illustrated in FIGS. 10, 10*a* and 10*b*, the protective face mask may be provided with a corresponding visor 43, which is preferably mechanically attached to the foam support 5 by means of protrusions 42 extending from inner surface of visor 43. Said protrusions 42 are adapted to be locked into corresponding slots 47 formed in the face engagement element 5. Visor 43 is not only functional, in that it is intended to protect or shade the eyes of the mask user from sunlight and the like, but also provides the mask with a certain aesthetic style. Furthermore, the provision of such visor 43 can also be intended to protect the lens 3: if the mask is dropped incorrectly onto a surface, visor 43 is shaped in such a way that it will deflect any deleterious blow to lens 3, and is thus intended to protect the lens against scratching and other undesirable effects.

The material used for the frame 45 of the foam support 5 is preferably nylon, or any other suitable material, so as to provide for a substantially rigid frame 45 of the foam support. Visor 43 is preferably made of a more flexible material such as a thermoplastic elastomer or Santoprene™, but may be made of other suitable materials.

An important advantage resulting from the present invention resides in that the foam support 5 is a separate piece that is removably mountable onto the protective face mask, and more particularly the support frame 7. It can be easily interchanged not only to replace foam 13 for either wear or hygienic reasons, but to customize mask 1 for any characteristic trait of a person's face. For example, the same mask 1 can be used during the transition from child to adult by simply swapping foam support 5 from a smaller to a larger size. Removable foam support 5 is advantageous for a same user during one day of use: if one foam support 5 becomes moist due to excessive perspiration, the user may easily replace a wet foam support 5 with a dry foam support 5, thereby resulting in a more enjoyable day of sports.

The foam support 5 and lens 3 according to the present invention are preferably designed so as to be removably mountable and fastened/clipped onto the mask in a "user friendly" manner so as to enable for an easier part replacement without the need of tools except a coin (see FIGS. 17-35).

Figure 18:
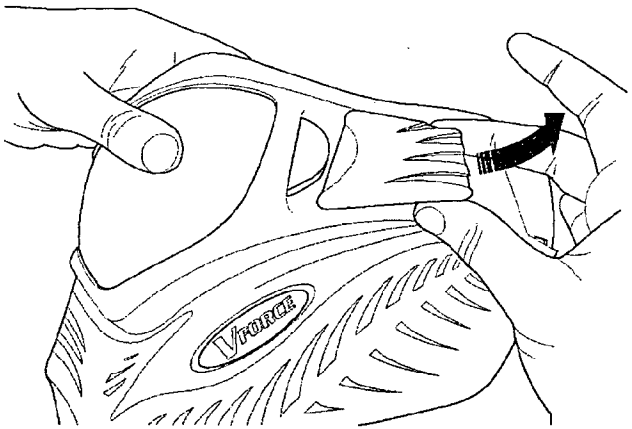
FIGS. 17-20 are partial schematic representations of the removal of a lens of a protective face mask according to a preferred embodiment of the present invention.
Figure 17:
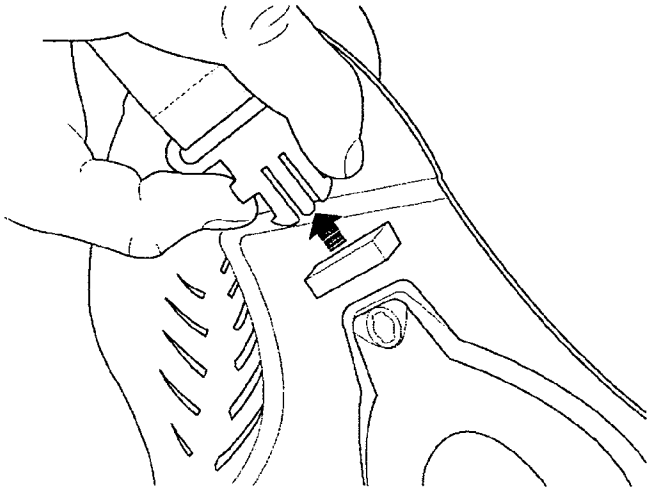
Figure 20:
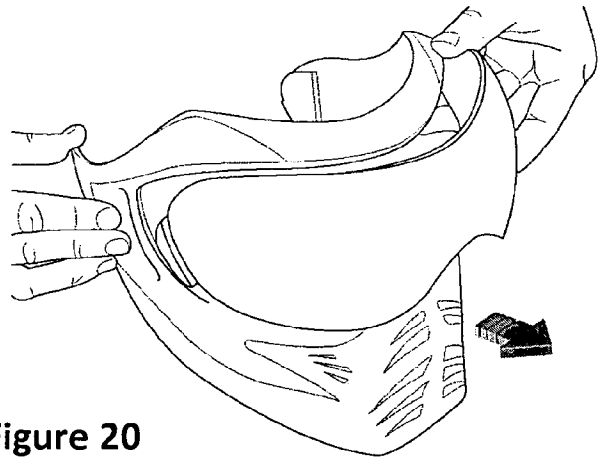
Figure 19:
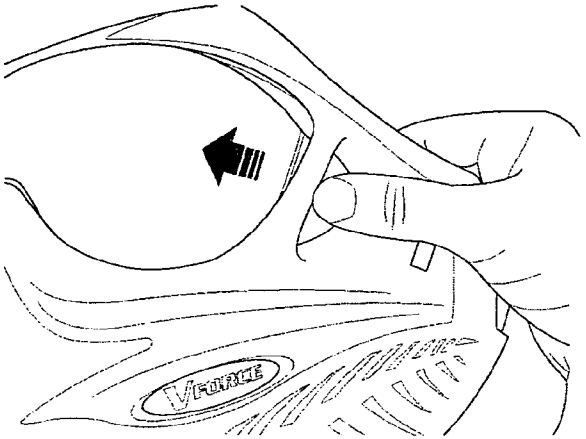

FIGS. 17-20 illustrate partial schematic representations of a removal of a lens from a protective face mask according to a preferred embodiment of the present invention, wherein FIG. 17 illustrates the declipping of the strap, FIG. 18 illustrates the removal of the lock clip 15, FIG. 19 illustrates the removal of one side at a time of the lens 3, and FIG. 20 illustrates the pushing of the lens 3 out of the frame.

Figure 22:
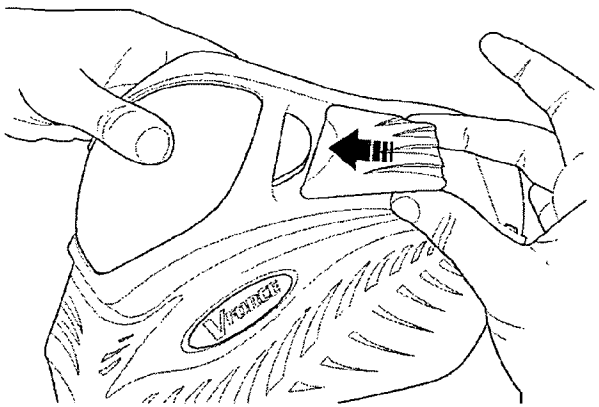
FIGS. 21-23 are schematic representations of the installation of a lens.
Figure 21:
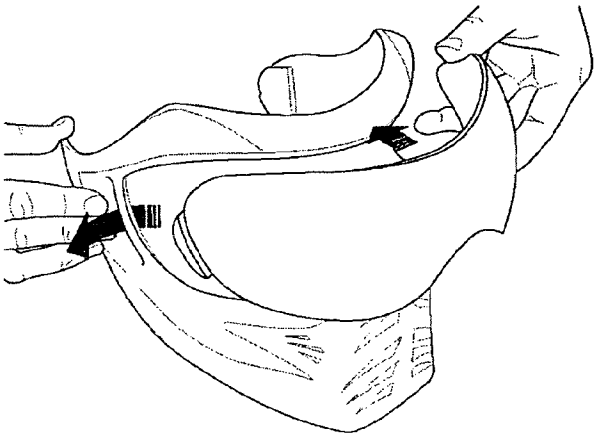
Figure 23:
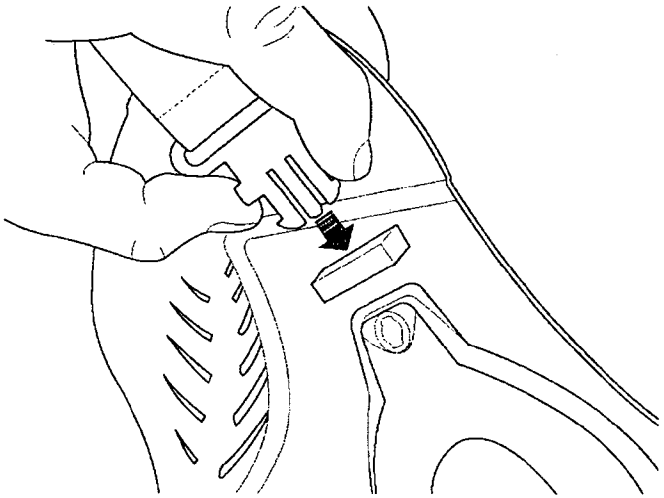

FIGS. 21-23 are partial schematic representations of the installation of the lens onto the protective face mask according to a preferred embodiment of the present invention, wherein FIG. 21 illustrates the insertion of the lens 3 onto the mask, FIG. 22 illustrates the insertion of the lock clip 15 back into place, a portion of the lock clip 15 being inserted behind an extremity 31 of the lens 3 so as to fasten and abut said extremity against the sidebar 33 of the support frame 7, and FIG. 23 illustrates the clipping of the strap 11 back into a corresponding protrusion 35*a* of the corresponding lock clip 15.

Figure 24:
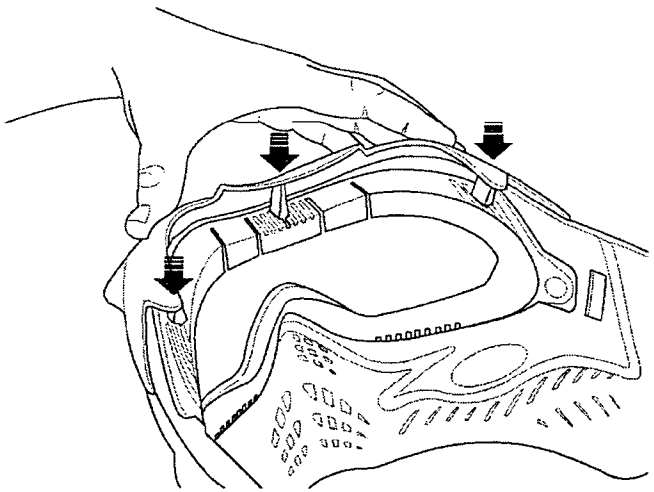
FIGS. 24 to 25 are schematic representations of installation of a visor.
Figure 25:
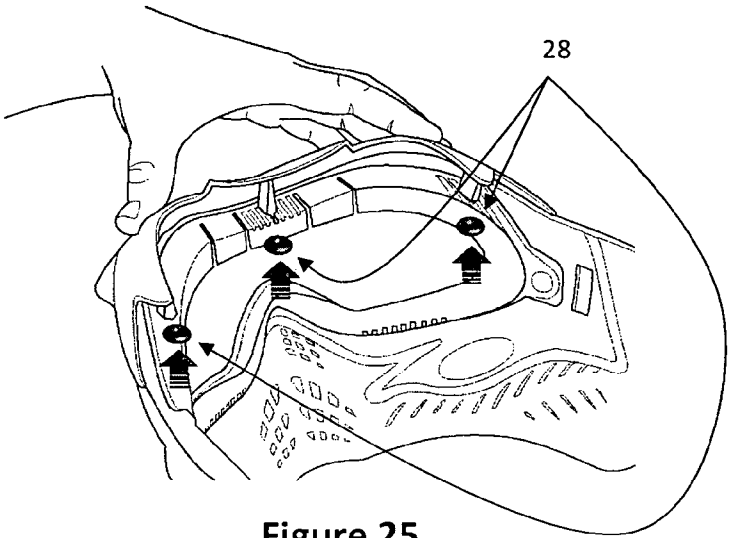

FIGS. 24 and 25 are schematic representations of the installation of a visor 43 onto the protective face mask according to a preferred embodiment of the present invention, wherein FIG. 24 illustrates the insertion of the visor, and more particularly the insertion of corresponding protrusions 42 of said visor 43 into corresponding slots 47 of the foam support 5, and FIG. 25 illustrates the insertion of corresponding o-rings 28 so as to property attach and secure the visor 43 to said foam support 5, as can be easily understood by a person skilled in the art.

Figure 26:
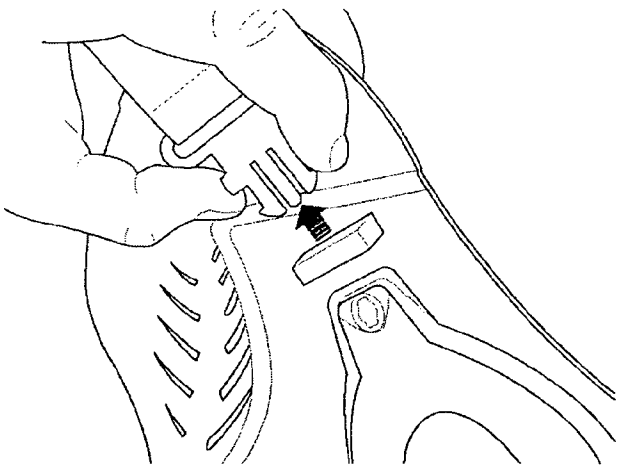
FIGS. 26-30 are a schematic representation of removal of replaceable foam portion.
Figure 28:
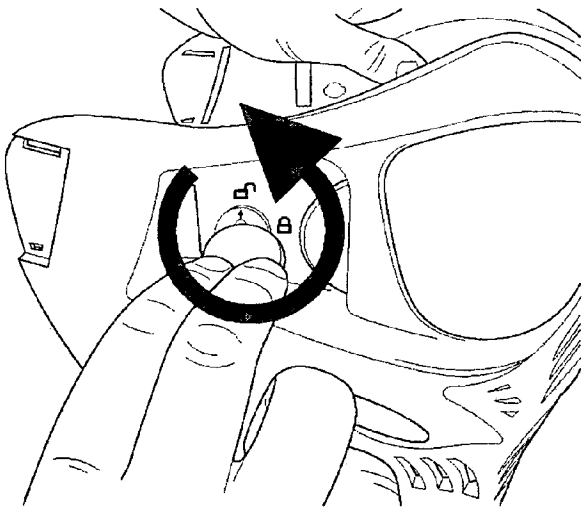
Figure 27:
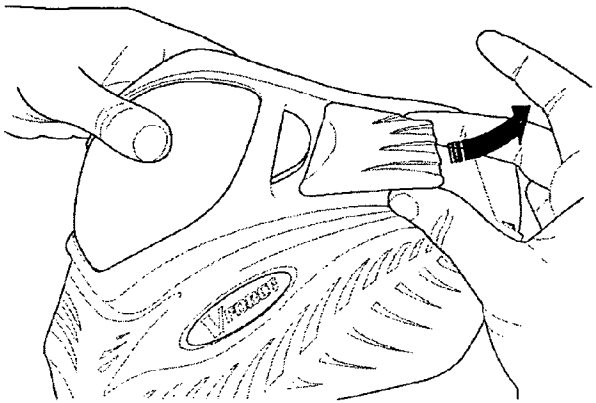
Figure 29:
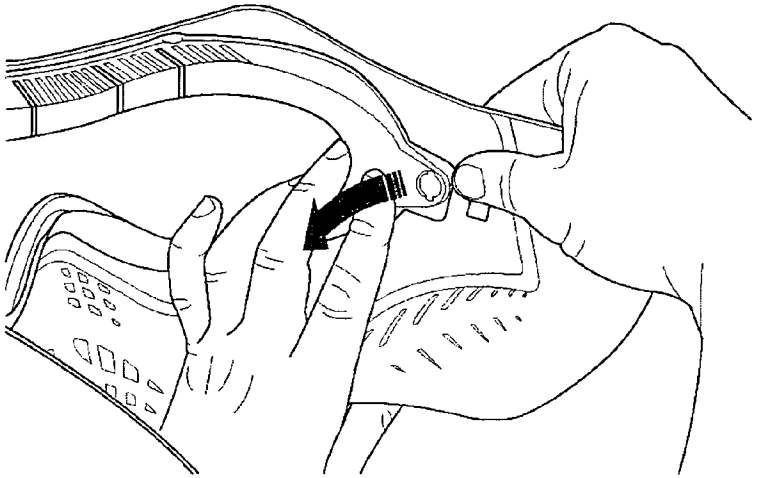
Figure 30:
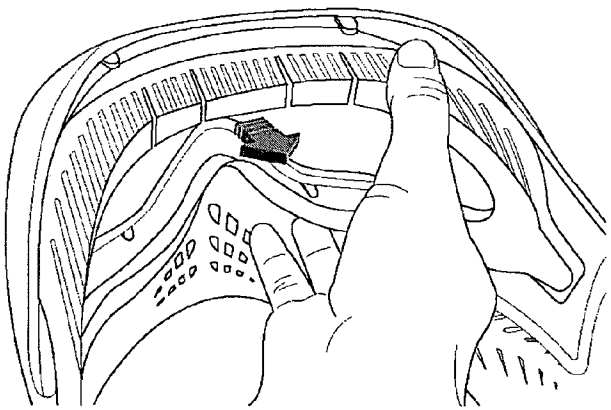

FIGS. 26-30 are partial schematic representations of a removal of a foam support 5 onto a protective face mask according to a preferred embodiment of the present invention, wherein FIG. 26 illustrates the declipping of the strap 11, FIG. 27 illustrates the removal of the lock clip 15, FIG. 28 illustrates the turning of the lock button 29 clockwise into the "unlocked" position, FIG. 29 illustrates the pulling of the foam support 5 on one side at a time from the support frame 7 of the mask, and FIG. 30 illustrates the removing of the foam 5 support from the frame 7.

Figure 32:
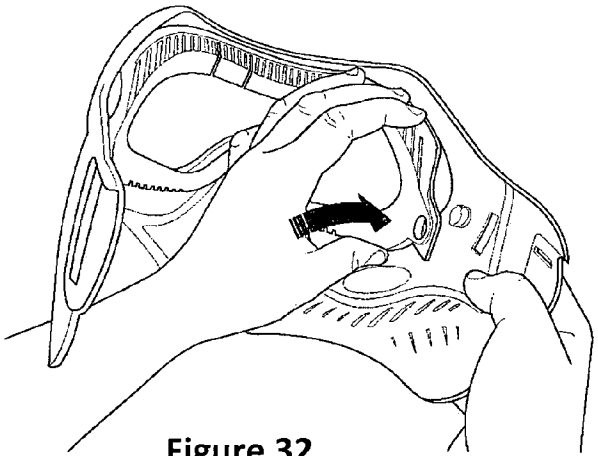
FIGS. 31-35 are a schematic representation of installation of replaceable foam portion.
Figure 31:
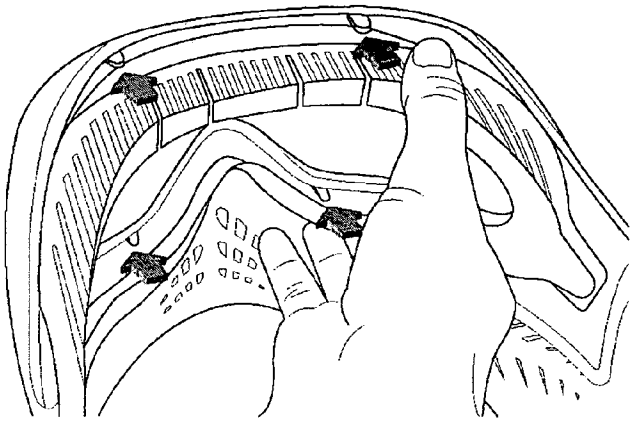
Figure 34:
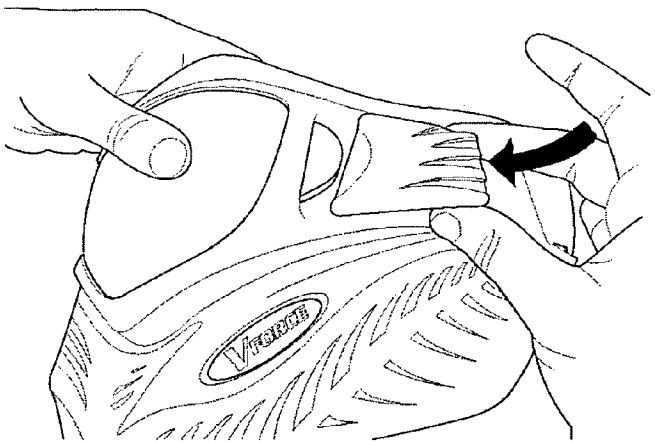
Figure 33:
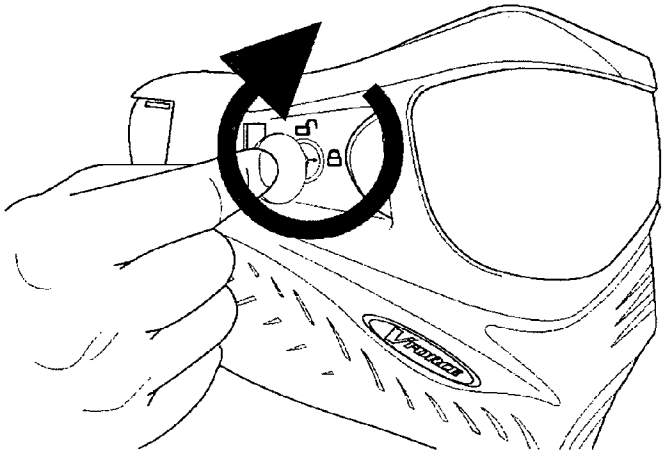
Figure 35:
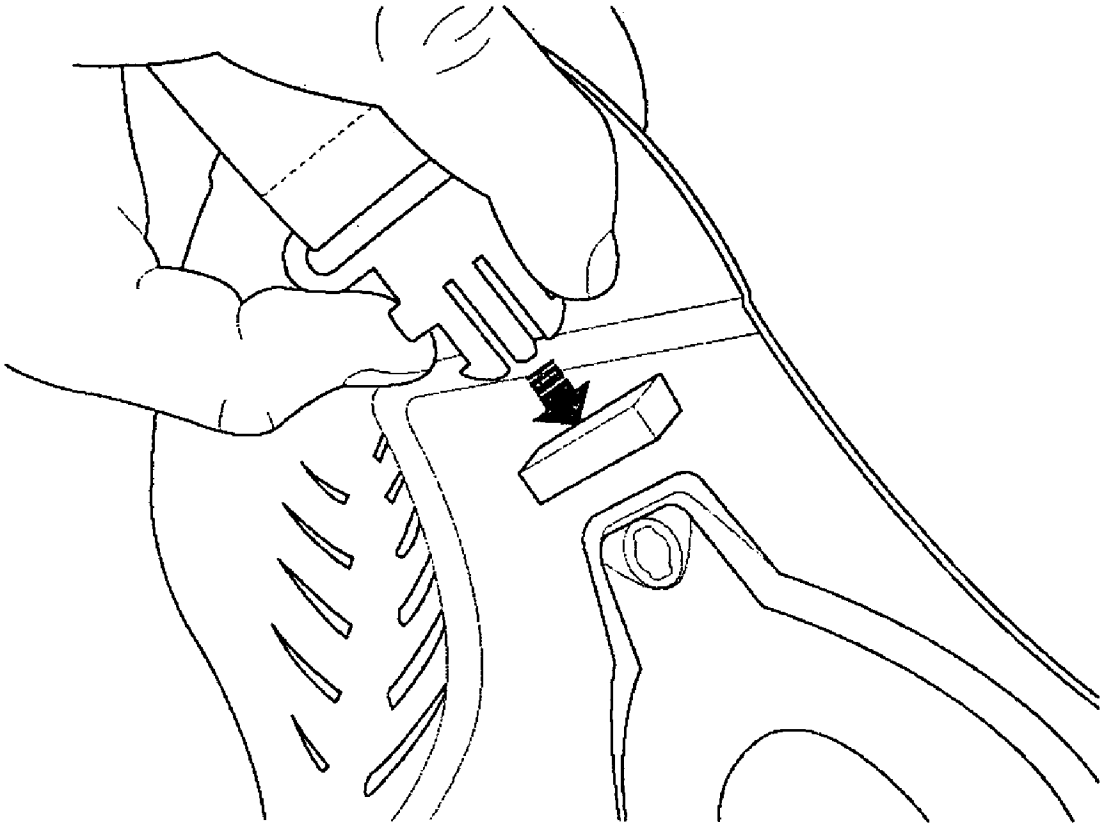

FIGS. 31-35 are partial schematic representations of the installation of a foam support 5 onto a protective face mask according to a preferred embodiment of the present invention, wherein FIG. 31 illustrates the insertion of the foam support 5 into the preferred corresponding four pins 21 projecting from an inner portion of the substantially rigid support frame 7 of the mask, FIG. 32 illustrates putting the foam support 5 back onto the support frame 7, one side at a time, FIG. 33 illustrates turning the lock button 29 counterclockwise into the "locked position", FIG. 34 illustrates the removing of the lock clip 15, and FIG. 35 illustrates the declipping of the strap 11.

Thus, in view of the above, it can be easily understood that the installation or removable of the foam support 5, and other components of the protective face mask, such as the lens 3, the visor 43, and the like, are easily carried out in a "user friendly" manner, without the use of specialized tools. For example, a user only requires to remove the strap 11 to be able to remove the corresponding lock clip 15, and thus operate the corresponding lock buttons 29 to properly remove the foam support 5 from the substantially rigid support frame 7 of the mask 1. The operation of the lock buttons 29, namely the operation between the corresponding locked and unlocked positions, can be carried out via a coin-shaped element (not shown) shaped to be insertable into a corresponding recess of the lock button 29. Preferably, the lock buttons 29 are designed so that each one of them be turned in a proper direction, along one quarter of a turn preferably, between corresponding demonstrative icons (see FIG. 28) representing the "unlocked" and "locked" positions.

Foam support 5 can be modified with casings or housings that would enable greater or improved ventilation or that can receive electronics to enable a system of communication with other protective face masks 1. Other applications for foam support 5 are possible as conceived by the skilled in the art.

As better shown in FIGS. 2 and 9, the foam support 5 is preferably provided with a corresponding frame 45 being shaped and sized accordingly to somewhat distance the face and eyes of a given user from the support frame 7 of the mask. Corresponding slots 47 on upper and lower portions of said support frame 45 of the foam support 5 enable improved air circulation between the face of the user and the lens to prevent condensation on the lens, and provide for more comfort. Upper slots 47 of the corresponding frame 45 of the foam support 5 are also intended to receive the projecting fastening pins 42 of a visor 43 according to a preferred embodiment of the present invention, seen on FIGS. 9-16, and the installation of said visor 43 as seen on FIGS. 24 and 25.

Considering that the material used for frame 45 of the foam support 5 is substantially rigid, frame 45 of said foam support 5 is preferably provided with a series of longitudinal slits 48 (FIG. 2*a*) on an inner portion thereof to provide the foam 5 support with a certain curvature flexibility.

Overmolded complementary mouth and ear portion 9 of the protective face mask is preferably provided with corresponding orifices and grilled portions so as to enable a proper breathing and/or hearing capability to the user of the mask, and preferably comprises distinguishing features so as to provide the mask with a corresponding esthetic profile. For example, the overmolded complementary portion of the mask preferably comprises a pair of rearwardly projecting horns 49 on the front mouth portion of the mask, and also preferably comprises corresponding upper intrusions 51 in the upper portion of the mask so as to be representative of "eyebrows", or other like features. Preferably also, the color of the material of the substantially rigid support frame 7 of the mask and that of the overmolded complementary portion 9 are different so as to create a visual contrast between the support frame and the corresponding overmolded portion. Thus, it can be easily understood by a person skilled in the art that one may use the technology of overmolding so as to provide the present protective face mask with corresponding overmolded complementary portions which would provide the mask with distinguishable esthetic features, so as to give a particular look to the mask, or to a corresponding family of masks, of a given manufacturer (distributor, wholesaler, etc.) of masks according to the present invention.

Finally, and according to the present invention, the mask and corresponding parts are preferably made of substantially rigid materials, such as hardened polymers, composite materials, and/or the like, whereas other components thereof according to the present invention, in order to achieve the resulting advantages briefly discussed herein, are preferably made of a suitably malleable and resilient material, such as a polymeric material (plastic, etc.), and/or the like, depending on the particular applications for which the mask is intended for and the different parameters in cause, as apparent to a person skilled in the art.

Furthermore, the present invention is a substantial improvement over the prior art in that, by virtue of its design and components, the mask 1 and corresponding parts are simple and easy to use, as well as are simple and easy to manufacture and/or assemble, without compromising the reliability of its functions. Hence, it may now be appreciated that the present invention represents important advantages over other masks and systems known in the prior art, as briefly explained hereinabove.

Thus, it can be seen that the objects of the present invention have been satisfied by the structure presented hereinabove. While in accordance with the Patent Statutes, only the best mode and preferred embodiments of the present invention have been presented and described in detail, it is to be understood that the invention is not limited thereto or thereby. Accordingly, for an appreciation of the true scope and breadth of the invention, references should be made to the following claims.

The invention claimed is:

1. A protective mask comprising:

a main body having a front opening, a foam support having a front side and a rear side, said rear side configured to abut against the face of a user, a pair of lock buttons which detachably secure said foam support to said main body, said lock buttons disposed on opposite sides of said main body, an elongated lens detachably disposed across said front opening, said lens having an outwardly protruding extremity at each end, a pair of lens lock clips, one lock clip removably associated with each side of said main body, each lock clip having a protrusion insertable through a receiving slot in the main body on its associated side of said main body, wherein upon insertion of said lock clip protrusion through its associated receiving slot and with said lens disposed across said front opening, said lock clip engages one of said lens extremities to lock said lens to said main body and simultaneously cover one lock button, and a strap having a connector at each end, said strap connectors releasably attachable to said lock clip protrusions after insertion of said lock clip protrusions through their associated receiving slots to thereby releasably attach said strap and said lock clips to said main body.

2. The mask as defined in claim 1 wherein said main body comprises a rigid frame and flexible mouth and ear portions attached to said frame.

3. The mask as defined in claim 1 wherein said lock buttons are rotatable relative to said main body between a lock position in which said lock buttons attach said foam support to said main body, and an unlocked position in which said lock buttons release said foam support from said main body.

* * * * *